United States Patent [19]

Wesson et al.

[11] Patent Number: 4,804,044

[45] Date of Patent: Feb. 14, 1989

[54] PERFORATING GUN FIRING TOOL AND METHOD OF OPERATION

[75] Inventors: David S. Wesson, Katy, Tex.; Michael E. McMahan, Duncan, Okla.; Flint R. George, Katy, Tex.

[73] Assignee: Halliburton Services, Duncan, Okla.

[21] Appl. No.: 40,219

[22] Filed: Apr. 20, 1987

[51] Int. Cl.[4] ..... E21B 43/116

[52] U.S. Cl. ..... 166/297; 166/55.1; 175/4.52

[58] Field of Search ..... 116/55, 55.1, 297; 175/4.52, 4.54

[56] References Cited

U.S. PATENT DOCUMENTS

| | | | |
|---|---|---|---|
| 3,675,718 | 7/1972 | Kanady | 166/297 |
| 4,484,632 | 11/1984 | Vann | 175/4.52 X |
| 4,544,034 | 10/1985 | George | 166/297 |
| 4,560,000 | 12/1985 | Up Church | 166/297 X |
| 4,564,076 | 1/1986 | Vann et al. | 166/297 X |
| 4,614,156 | 9/1986 | Colle, Jr. et al. | 102/312 |
| 4,633,952 | 4/1984 | Riggenburg | 166/336 |
| 4,655,298 | 4/1987 | George et al. | 175/4.52 |

OTHER PUBLICATIONS

Vann System Equipment-"Time Delay Firing Head" (1987).

Vann Systems Equipment-"Annulus Pressure Firing Head" (1987).

Vann Systems Equipment-"Releasable Annulus Pressure Firer" (1987).

Vann Systems Equipment-"Pressure Actuated Firing Head" (1987).

*Primary Examiner*—Stephen J. Novosad
*Assistant Examiner*—William P. Neuder
*Attorney, Agent, or Firm*—Arnold, White & Durkee

[57] ABSTRACT

A tool for activating the firing head of a perforating gun located below a packer by applying pressure to the upper well annulus while maintaining an unimpeded bore between the perforating gun and the pipe string. The tool is provided with a flow valve to prevent flow through the flow bore when closed, and a circulation valve which permits fluid flow from the upper annulus into the flow bore when open and a means of switching the valves so that when one is open the other is closed. A method of using the tool to complete a well is also disclosed.

25 Claims, 5 Drawing Sheets

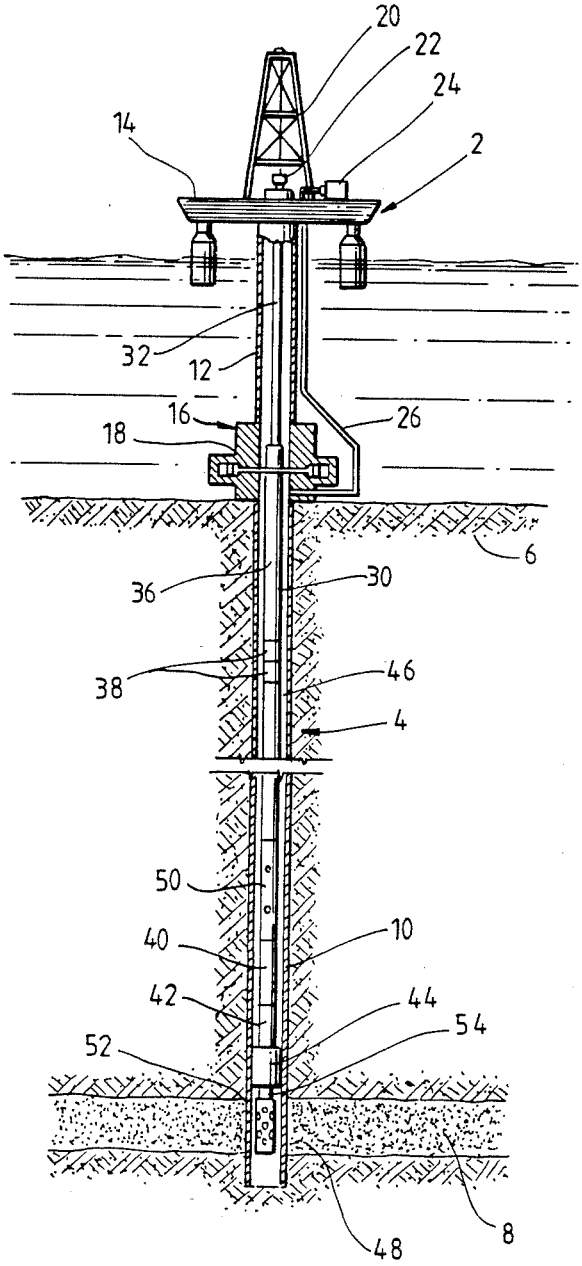
Fig.1
Fig.2 G
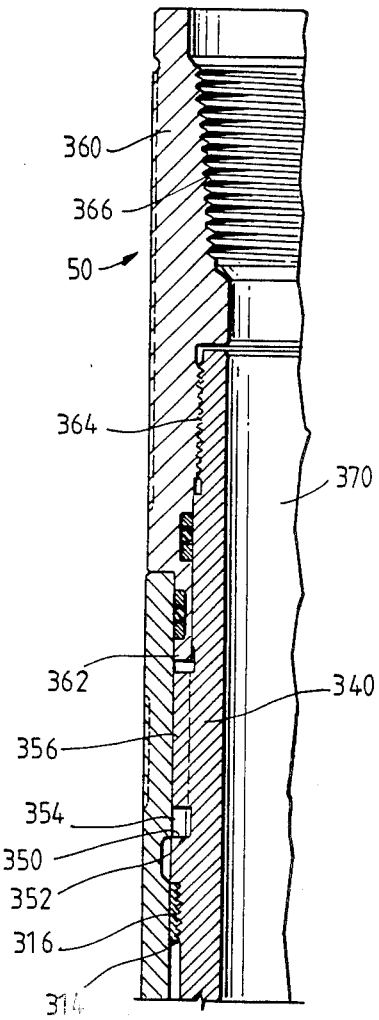

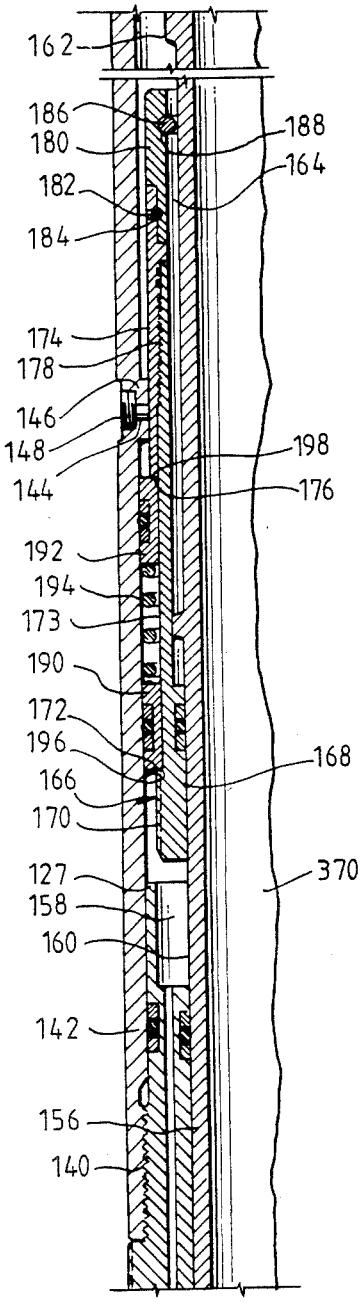
Fig.2C
Fig.2B
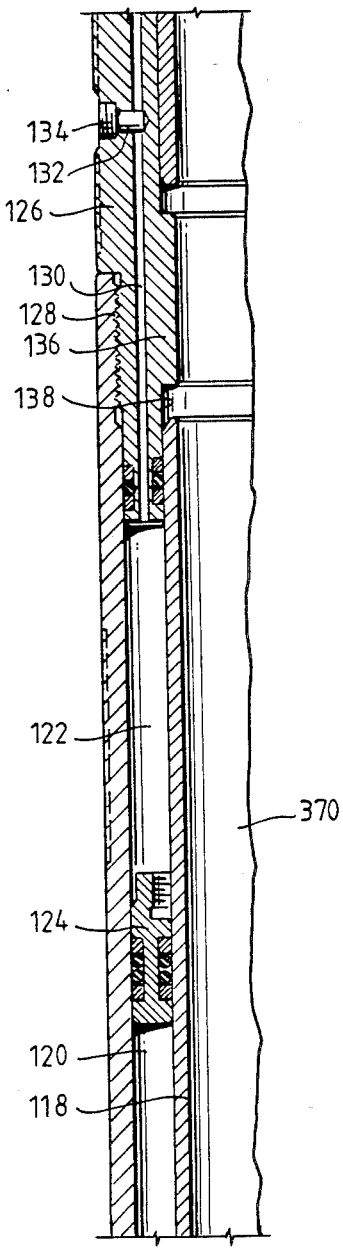
Fig.2A
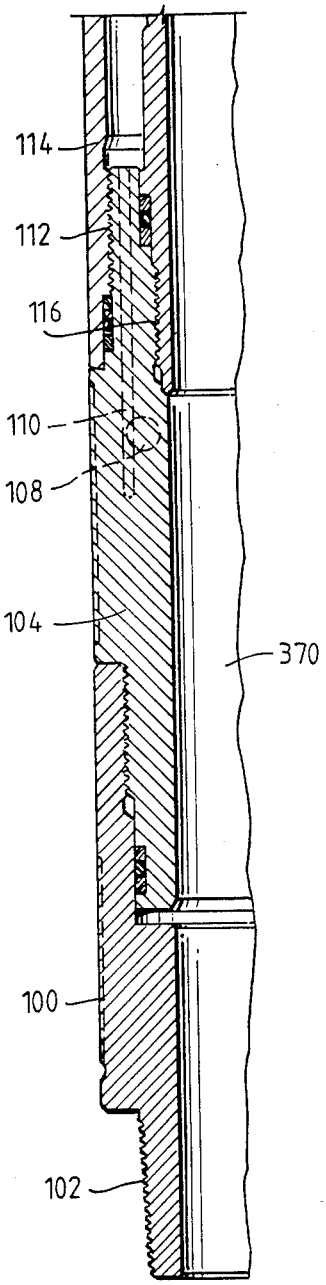

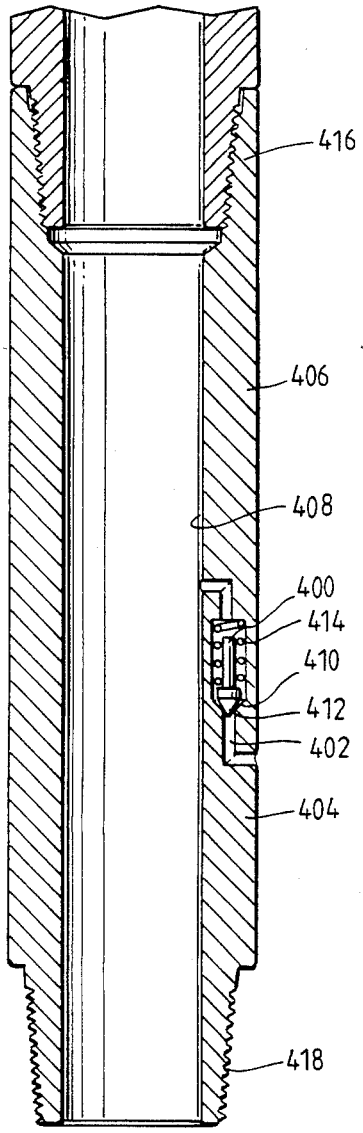
Fig. 5
Fig. 4
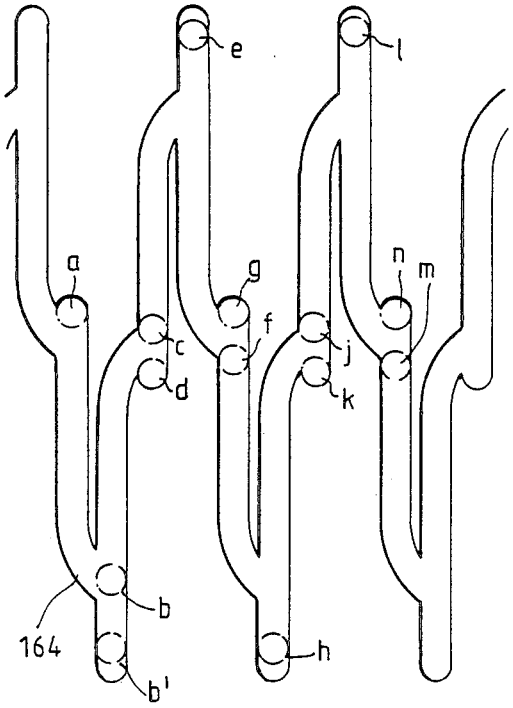

PERFORATING GUN FIRING TOOL AND METHOD OF OPERATION

BACKGROUND OF THE INVENTION

The invention relates to a device for use in activating an explosive charge downhole in a wellbore.

After a wellbore has been cased and the casing cemented into place, it is common practice to form perforations in the casing and cement in the region of hydrocarbon bearing formation using a perforating gun. This is lowered into position, and then fired.

One prior art means of firing the gun is to use a firing head which is actuated by a metal bar dropped down the tubing string. While this means has the advantage that the gun does not go off prematurely, it obviously cannot be used in wellbores that deviate significantly from the vertical. Another disadvantage is that the firing head may become fouled by heavy drilling mud or debris before the bar is dropped, preventing actuation of the gun.

Various means have been proposed to use pressure applied at the wellhead to actuate the perforating gun. Because of the potentially serious consequences of premature detonation, the actuating mechanism must be able to prevent accidental detonation by pressure changes while the gun is being put into position.

One method is to apply pressure through the tubing string to a pressure responsive firing device, an example of which is disclosed in U.S. Pat. No. 4,544,034 to George. The firing device is in fluid communication with the surface, either using a liquid or nitrogen, and pressure applied at the surface is communicated through the fluid column to the firing device. While this is a useful system in many applications, it is not suitable in those circumstances where a full column of fluid in the tubing string cannot be used. It may also be unsuitable when the formation pressure is low, and it is not possible to bleed off sufficient fluid between actuation and firing to produce a condition of underbalance at the time of perforation.

A method of using the annulus pressure to activate the firing mechanism is disclosed in U.S. Pat. Nos. 4,484,632 to Vann and 4,564,076 to Vann et al. When the perforating gun is in position a packer is set above the formation. An increase in the annulus pressure above the packer is communicated to a lever mechanism inside the tube. At a predetermined pressure, shear pins break and the lever operates the firing mechanism of the perforating gun. This method permits shooting underbalanced, but has the disadvantage that the lever mechanism obstructs part of the tube bore, so that full bore tools cannot be passed down the tube beyond the firing device.

SUMMARY OF THE INVENTION

The present invention provides a means of using annulus pressure to operate a pressure activated firing device for a perforating gun without obstructing the tube bore. It is particularly suited to situations where a full column of fluid in the tube cannot be used, or where it is necessary or desirable to perforate the casing underbalanced.

The apparatus comprises a pipe string with a packer, and a perforating gun at the end of the string. The string is fitted with a flow valve located above the packer which prevents fluid flow through the bore of the pipe when it is closed. Below the flow valve and above the packer the wall of the pipe is provided with one or more valves giving access from the annulus to the tube bore when open. Means are provided which operate the valves, opening one while closing the other.

In a preferred embodiment, the access annulus valves are comprised of circulation ports in the wall of the pipe string and a valve sleeve which slides longitudinally against the inside wall of the pipe string and which contains circulation apertures alignable with the circulation ports.

Preferably, the valve sleeve is moved by a tubular mandrel which slides up and down against the interior wall of the tool. This mandrel is also adapted to open and close the flow valve so that the flow valve opens when the circulation valve closes and vice versa. The mandrel moves in response to changes in the upper annulus pressure.

Movement of the mandrel is effected by an operating fluid housed between the tool wall and the mandrel which is in communication with the pressure in the upper annulus and a double acting piston which moves in response to pressure differentials across it caused by pressure changes in the operating fluid. The piston moves the mandrel, preferably through a ball and slot ratchet mechanism which controls the longitudinal movement of the mandrel.

In the preferred embodiment, the double-acting pistons have means for dumping the fluid when they reach the end of their stroke, thus equalizing the pressure on both sides of the piston and preventing further movement.

In an alternative embodiment, the access annulus valve is a chemical injection type valve which opens when there is sufficient pressure in the upper annulus and closes when that pressure is released. This is preferably used in conjunction with a flow valve operated by annulus pressure.

The method of using the apparatus of the invention to complete a well comprises suspending the apparatus in the well with the perforating gun in the location to be perforated, and setting the packer to form an upper and lower annulus. The flow valve is closed and the annulus access valves are opened. The pressure in the upper annulus is then increased to the pressure required to activate the pressure-activated firing head of the perforating gun. Once the firing head is actuated the annulus access valves are closed and the flow valve is opened, permitting fluids to flow from the formation through the well perforation up the pipe string to the surface. If a time delay firing head is used, pressure can be bled off the tool through the open flow valve after the firing head is activated and before the gun detonates to permit perforation at underbalance.

A primary object of the present invention is the provision of a safe, pressure activated means of detonating a perforating gun in response to a predetermined pressure applied from the surface, while maintaining an unobstructed flow bore throughout the pipe string.

A further object of the present invention is the provision of a tool which can be readily cycled to test packer seal integrity, to activate the firing head and to allow firing the perforating gun underbalanced.

BRIEF DESCRIPTION OF THE DRAWINGS

FIG. 1 schematically depicts a perforating gun firing tool in accordance with the present invention disposed within a well, depicted in partial vertical section;

FIGS. 2A–2G depict the perforating gun firing tool of FIG. 1 in greater detail and in half vertical section;

FIG. 4 schematically depicts the ball race of the perforating gun firing tool of FIG. 2;

FIG. 5 depicts a circulation valve useful with an alternative embodiment of the perforating gun firing tool in accordance with the present invention.

DETAILED DESCRIPTION OF CERTAIN PREFERRED EMBODIMENTS

Figure 2F:
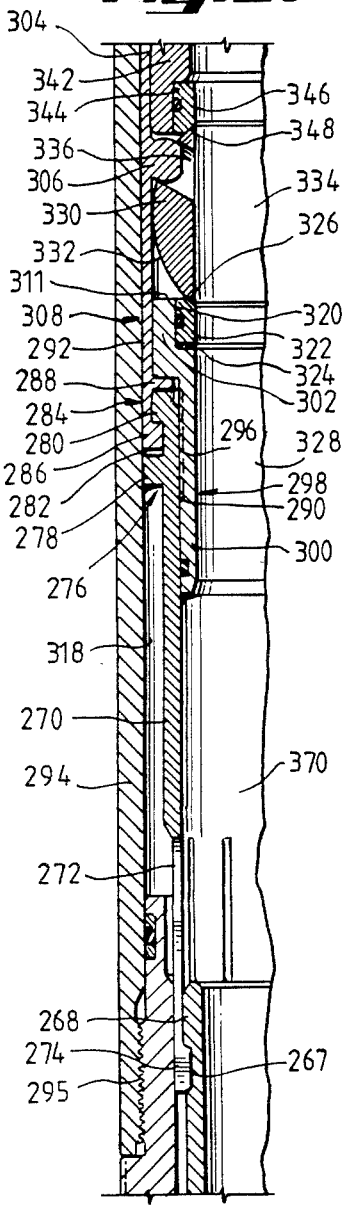
Figure 2E:
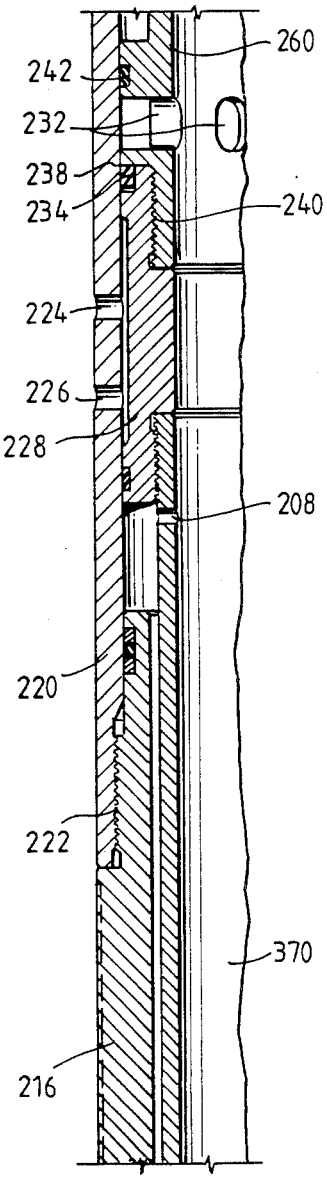
Figure 2D:
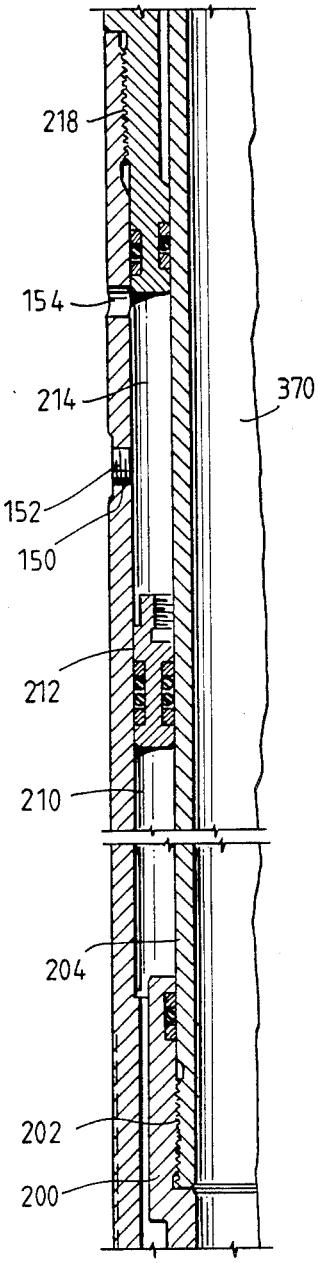

Referring to FIG. 1, the present invention is shown schematically incorporated in a perforating gun firing string deployed in an offshore oil or gas well. Platform 2 is shown positioned over a submerged oil or gas well bore 4 located in sea floor 6, well bore 4 penetrating potential producing formation 8. Well bore 4 is shown to be lined with steel casing 10, which is cemented into place. A subsea conduit 12 extends from the deck 14 of platform 2 into a subsea wellhead 16, which includes a blowout preventer 18 therein. Platform 2 carries a derrick 20 thereon, as well as a hoisting apparatus 22, and a pump 24 which communicates with the well bore 4 via control conduit 26, which extends below blowout preventer 18.

A perforating gun firing string 30 is shown disposed in well bore 4, with blowout preventer 18 closed thereabout. Perforating gun firing string 30 includes upper drill pipe string 32 which extends downward from platform 2 to wellhead 16, below which extends intermediate pipe string 36. Slip joint 38 may be included in string 36 to compensate for vertical motion imparted to platform 2 by wave action; slip joint 38 may be similar to that disclosed in U.S. Pat. No. 3,354,950 to Hyde. Below slip joint 38 intermediate string 36 extends downwardly to perforating gun firing tool 50 of present invention. Below firing tool 50 is lower pipe string 40, extending to tubing seal assembly 42, which stabs into packer 44. When set, packer 44 isolates well bore annulus 46 from lower well bore annulus 48. Packer 44 may be any suitable packer well known in the art, such as, for example, a Baker Oil Tool Model D packer, an Otis Engineering Corporation type W packer, or Halliburton Services CHAMP®, RTTS or EZ DRILL® SV packers. Below the tubing seal assembly is perforating gun 52, which may be any type of tubing pressure actuated perforating gun known in the art. Particularly preferred is the perforating gun with time delay firing mechanism disclosed in U.S. Pat. No. 4,614,156 to Colle et al. Perforating gun 52 is actuated by a pressure responsive firing head 54 located in the pipe string below packer 44.

Referring to FIGS. 2A–2G, tool 50 is shown in section, commencing at the bottom of the tool with lower adapter 100 having threads 102 therein at its lower end, whereby tool 50 is secured to lower pipe string 40. Lower adapter 100 is secured to nitrogen valve housing 104 at threaded connection 106, housing 104 containing a valve assembly (not shown), such as is well known in the art, in lateral bore 108 in the wall thereof, from which extends up longitudinal nitrogen charging channel 110.

Valve housing 104 is secured by threaded connection 112 at its outer upper end to tubular pressure case 114, and by threaded connection 116 at its inner upper end to gas chamber mandrel 118, case 114 and mandrel 118 defining pressurized gas chamber 120 and lower oil chamber 122, the two being separated by floating annular piston 124.

The lower end of oil channel coupling 126 extends between case 114 and gas chamber mandrel 118, and is secured to the upper end of case 114 at threaded connection 128. A plurality of longitudinal oil channels 130 (one shown) extend from the lower end of coupling 126 to the upper end thereof. Radially drilled oil fill ports 132 extend from the exterior of tool 50, intersecting channels 130 and are closed with plugs 134. Annular shoulder 136 extends radially inward from inner wall 138 of coupling 126. The upper end of coupling 126, including annular overshot 127, is secured at threaded connection 140 to the lower end of ratchet case 142, through which oil fill ports 144 extend at annular shoulder 146, being closed by plugs 148. At the upper end of ratchet case 142 are additional oil fill ports 150 closed by plugs 152 and open pressure ports 154.

Ratchet slot mandrel 156 extends downward within the upper end of oil channel coupling 126. Annular ratchet chamber 158 is defined between mandrel 156 and case 142. The lower exterior 160 of mandrel 156 is of substantially uniform diameter, while the upper exterior 162 is of greater diameter so as to provide sufficient wall thickness for ratchet slot 164. FIG. 4 shows the pattern of ratchet slot 164 extending 180° around the exterior of ratchet slot mandrel 156. The same pattern is repeated on the second 180° of the exterior of mandrel 156, making a continuous slot 164 around mandrel 156.

Ball sleeve assembly 166 surrounds ratchet slot mandrel 156, and comprises lower sleeve 168 including radially outwardly extending annular shoulder 170 having annular piston seat 172 thereon. Above shoulder 170, ratchet piston support surface 173 extends to the upper end of lower sleeve 168, which is overshot by the lower end of upper sleeve 174 having annular piston seat 176 thereon, and to which is secured at threaded connection 178. Ball sleeve 180 is disposed at the top of upper sleeve 174, and is secured thereto at swivel bearing race 182 by a plurality of bearings 184. Two ratchet balls 186 each extend into a ball seat 188 on diametrically opposite sides of ball sleeve 180 and into a ratchet slot 164 of semicircular cross-section. Due to this structure, when balls 186 follow the path of slots 164, ball sleeve 180 rotates with respect to upper sleeve 174, the remainder of ball sleeve assembly 166 does not rotate, and only longitudinal movement is transmitted to ratchet mandrel 156 by balls 186.

Lower annular ratchet piston 190 and upper annular ratchet piston 192 ride on piston support surface 173 on lower sleeve 168, coil spring 194 being disposed therebetween. Lower ratchet piston 190 carries radial sealing surface 196 on its lower end, while upper ratchet piston 192 carries radial sealing surface 198 on its upper end.

The upper end 200 of ratchet slot mandrel 156 is secured at threaded connection 202 to extension mandrel 204 having relief ports 208 extending therethrough. Annular upper oil chamber 210 is defined by ratchet case 142 and extension mandrel 204. Annular floating piston 212 slidingly seals the bottom of upper oil chamber 210 and divides it from well fluid chamber 214 into which pressure ports 154 opens. The upper end of ratchet case 142 is secured at threaded connection 218, to extension case 216, which surrounds extension mandrel 204.

Circulation housing 220 is threaded at 222 to extension case 216, and possesses a plurality of circumferentially spaced radially extending circulation ports 224 extending through the wall thereof. A plurality of apertures 226 are provided to prevent fluid lock when circulation ports 224 are in communication with the interior bore of tube 50.

Circulation port sleeve 228 is threaded to extension mandrel 204 at 230. Valve apertures 232 extend through the wall of circulation valve sleeve 238, and are isolated from circulation ports 224 by annular seal 234, which is disposed in seal recess 236 formed by the junction of circulation valve sleeve 228 with displacement valve sleeve 238, the two being threaded together at 240. Above valve apertures 232 is annular seal 242 disposed in a groove on external surface of displacement valve sleeve 238.

Above valve apertures 232, operating mandrel 260 extends upwardly to exterior annular recess 267, which separates annular shoulder 268 from the main body of mandrel 260.

Collet sleeve 270, having collet fingers 272 extending downward therefrom, engages operating mandrel 260 through the accommodation of radially inwardly extending protuberances 274 by annular recess 267. As is readily noted in FIG. 2G, protuberances 274 and the lower portions of fingers 272 are confined between the exterior of mandrel 260 and the interior of circulation displacement housing 220.

At the upper end of collet sleeve 270, coupling 276 comprising flanges 278 and 280, with exterior annular recess 282 therebetween, grips coupling 284, comprising inwardly extending flanges 286 and 288 with interior recess 290 therebetween, on each of two ball operating arms 292. Couplings 276 and 284 are maintained in engagement by their location in annular recess 296 between ball case 294, which is threaded at 295 to circulation displacement housing 220, and ball housing 298. Ball housing 298 is of substantially tubular configuration, having a lower smaller diameter portion 300 and an upper, larger diameter portion 302 which has two windows 304 cut through the wall thereof to accommodate the inward protrusion of lugs 306 from each of the two ball operating arms 292. Windows 304 extend from shoulder 311 upward to shoulder 314 adjacent threaded connection 316 with ball support 340. On the exterior of the ball housing 298, two longitudinal channels (location shown by arrow 308) of arcuate cross-section and circumferentially aligned with windows 304, extend from shoulder 310 upward to shoulder 311. Ball operating arms 292, which are of substantially the same arcuate cross-section as channels 308 and lower portion 302 of ball housing 298, lie in channels 308 and across windows 304, and are maintained in place by the interior wall 318 of ball case 294 and the exterior of ball support 340.

The interior of ball housing 298 possesses lower annular seat recess 320, within which annular ball seat 322 is disposed, being biased upwardly against ball 330 by ring spring 324. Surface 326 of lower seat 322 comprises a metal sealing surface, which provides a sliding seal with the exterior 332 of valve ball 300.

Valve ball 330 includes a diametrical bore 334 therethrough, of substantially the same diameter as bore 328 of ball housing 298. Two lug recesses 336 extend from the exterior 332 of valve ball 330 to bore 334.

The upper end 342 of ball support 340 extends into ball housing 298, and carries upper ball seat recess 344 in which annular upper ball seat 346 is disposed. Upper ball seat 346 possesses arcuate metal sealing surface 348 which slidingly seals against the exterior 332 of valve ball 330. When ball housing 298 is made up with ball support 340, lower and upper ball seats 322 and 346 are biased into sealing engagement with valve ball 330 by spring 324.

Exterior annular shoulder 350 on ball support 340 is contacted by the lower ends 352 of splines 354 on the exterior of ball case 294, whereby the assembly of ball housing 294, ball operating arms 292, valve ball 330, ball seats 322 and 346 and spring 324 are maintained in position inside of ball case 294. Splines 354 engage splines 356 on the exterior of ball support 340, and thus rotation of the ball support 340 and ball housing 298 within ball case 298 is prevented.

Upper adapter 360 protrudes at its lower end 362 between ball case 298 and ball support 340, sealing therebetween, when made up with ball support 340 at threaded connection 364. The upper end of upper adapter 360 carries on its interior threads 366 for making up with portions of drill string above tool 50.

When valve ball 330 is in its open position, as shown in FIG. 2G, a "full open" bore 370 extends throughout tool 50, providing an unimpeded path for formation fluids and/or for perforating guns, wireline instrumentation, etc.

OPERATION OF A PREFERRED EMBODIMENT OF THE PRESENT INVENTION

Referring to FIGS. 1 through 4, operation of the firing tool 50 of the present invention is described hereinafter.

As tool 50 is run into the well on string 30 it is in the position shown in FIGS. 2A–G, with ball valve 330 open and circulation valves 232 closed. With respect to FIG. 4, balls 186 will be in position "a" in slots 164 as tool 50 is run into the well bore 10.

As tool 50 is being run into the well, well fluids enter the pipe string through perforations in the string below tool 50 and pass through flow valve 330 to form a fluid cushion above tool 50. As tool 50 descends, the hydrostatic pressure increases on it. The effect of this pressure, communicated to the tool through hydrostatic ports 154, is to move floating piston 212 downward. This increases the pressure on the fluid in upper oil chamber 210, which is in fluid communication with ratchet chamber 158. Lower ratchet piston 190 is pushed downwards, moving ball sleeve assembly 166 and balls 186 downwards. The oil is prevented from by-passing piston 190 by the metal to metal seal of sealing surface 196 on piston seat 172. When balls 186 reach position "b" shown on FIG. 5, piston 190 reaches overshot 127 which prevents further downward movement. Further fluid pressure acts on shoulder 170 of lower sleeve 168, spreading piston seat 172 from seating surface 196, breaking the seal and dumping oil past lower sleeve 168, which equalizes the pressures on both sides of piston 190, stopping further movement of ball sleeve assembly 166.

In order to shut the cushion in at the desired depth, it is necessary to close the flow valve, to prevent any further well fluid entering the string, and to open the circulating valve. To perform this operation, the annulus pressure is increased, moving balls 186 to position "b". The annulus pressure is then reduced. This reduction in pressure causes floating piston 212 to move upward, pulling ball sleeve assembly 116 upward, and causing balls 186 to move into positions "c". This operation effects no change in the position of the valves.

Figure 3B:
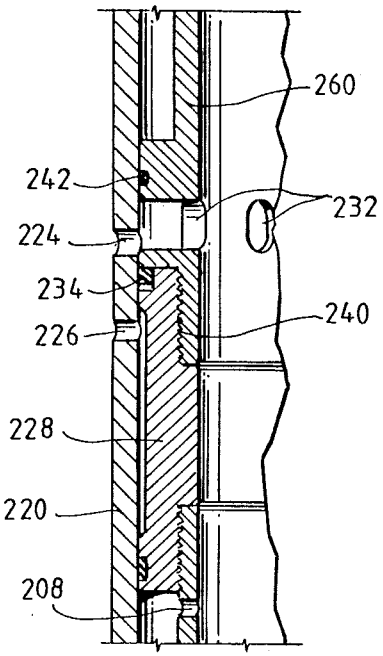
FIGS. 3A and 3B depict the ball valve and annulus pressure port of the perforating gun firing tool of FIG. 2.
Figure 3A:
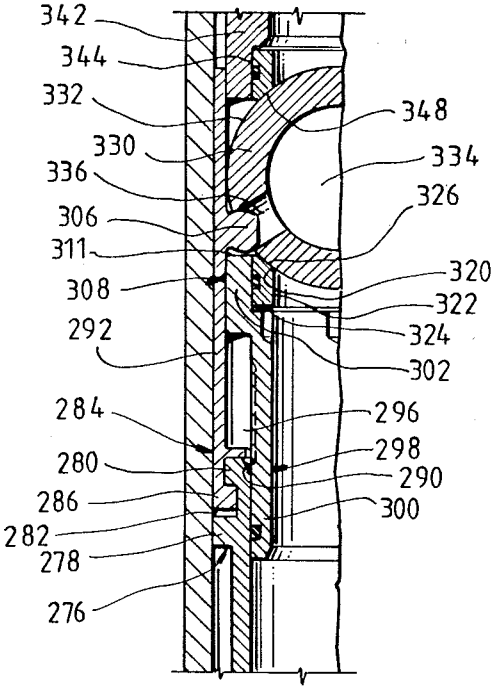

In order to close the flow valve 330 to shut the cushion in, pressure is increased in annulus 46 by pump 24 via control conduit 26. This increase in pressure is transmitted through pressure ports 154 into well fluid chamber 214, where it acts upon floating piston 212, moving it downward. The pressure is transmitted through the fluid in upper oil chamber 210 to ratchet chamber 158, where the pressurized oil presses on lower ratchet piston 190. The oil is prevented from bypassing piston 190 by the metal to metal seal of sealing surface 196 on piston seat 172. Piston 190 therefore pushes against shoulder 170 on lower sleeve 168, which in turn pulls upper sleeve 174, ball sleeve 180 and balls 186 downward in slots 164 to position "d". This moves ratchet mandrel 156 downwards, which pulls extension mandrel 204, circulation port sleeve 228, circulation valve sleeve 238 and operating mandrel 260 downwards. Operating mandrel 260 pulls collet sleeve 270 downwards, which pulls arms 292 and rotates flow valve 330. Flow valve 330 is now closed and circulation ports 224 are aligned with apertures 232 as shown in FIGS. 3A and B. The annulus pressure is then released.

When the annulus pressure is decreased, the pressurized nitrogen in chamber 120 pushes against floating piston 124, and the pressure is transmitted through lower oil chamber 122, channels 130 and ratchet chamber 158 against upper ratchet piston 192. As piston 192 is biased against piston seat 176, a metal to metal seal is effected at sealing surface 198 and ball sleeve assembly 166 is pushed upwards. The ratchet balls 186 are now in position "e" in slots 164 as shown in FIG. 4. At this point further travel of upper ratchet piston 192 is prevented by annular shoulder 146, and further action of the pressurized fluid spreads sealing surface 198 from seat 176. Fluid pressures are thereby equalized on either side of piston 192, preventing further travel of ball sleeve assembly 166 and balls 186 remain in position "e".

The string is then run further into the well until the perforating gun reaches the position adjacent to the formation to be perforated, and the packer is set.

The packer is then tested by again pressuring the upper annulus 46. This increase of pressure moves balls 186 to positions "f" in slots 164 shown in FIG. 4, by the same means as described above. The pressure is then decreased, moving balls 186 to position "g" where they shoulder against slots 164 and effect upwards movement of ratchet mandrel 156, extension mandrel 204, circulation valve sleeve 238, operating mandrel 260 and collet sleeve 270. This has the effect of closing circulation ports 224 by moving apertures 232 out of alignment and opening flow valve 330 by means of arms 292.

The packer is then tested by increasing the annulus pressure. This increase in pressure moves the ball sleeve assembly 166 upwards until balls 186 are in position "h" shown in FIG. 4. At this point further travel is prevented by lower pistons 190 reaching overshot 127 and fluid breaking the seal and equalizing the pressure on both sides of piston 190, and no change in valve positions is effected.

When the packer test is completed the annulus pressure is released, moving balls 186 to position "j" shown on FIG. 4. The annulus is then pressured to move balls 186 into position "k" in slot 164 shown on FIG. 4, at which point flow valve 330 closes and circulation valve 232 opens. Pressure is then released, moving balls 186 to position "l".

Pressure is then increased in the annulus until a sufficient pressure to actuate the firing head 54 is reached. This increase in pressure moves balls 186 to position "m" shown on FIG. 5. Once the firing head 54 has been actuated, the pressure in the annulus is decreased, moving the balls 186 to position "n" where the flow valve 330 is opened and the circulation valves 232 are closed. The pressure in the tubing string can then be bled off before the perforating gun fires, if a time delay firing system is used, creating a suitable underbalance at the time of perforation.

In an alternative mode of operation, the tool 50 may be run down the well in the position shown in FIGS. 3A and B, with ball valve 330 closed and circulation valves 232 open. This would be done if no cushion was desired, or if a cushion is to be supplied by fluids injected from the surface after the perforating gun 52 is in position. In this mode the balls 186 would start at position "d" on FIG. 5, and would thereafter follow the same cycle.

ALTERNATE EMBODIMENT OF THE PRESENT INVENTION

An alternative embodiment of the present invention is shown in FIG. 5. The circulation valve with slideable sleeve of the above described embodiment is replaced by injection valve 400. The valve 400 is lodged in bore 402 which connects the exterior 404 of valve housing 406 with interior 408. The head 410 of valve 400 is maintained in sealing contact with the sloping shoulders 412 of bore 402 by coil spring 414. The spring 414 is selected so that it will begin to compress at a predetermined pressure dependent upon the particular circumstances in which the invention is to be used, which is readily calcuable by those of ordinary skill in the art. When this pressure is present in the annulus field, the head 410 is forced out of sealing contact with shoulders 412 and fluid flows past valve 400 through bore 402 into the interior 408.

When the pressure in the annulus is reduced below the predetermined pressure, spring 414 forces head 410 back into sealing contact with shoulders 412, closing valve 400 and preventing flow in either direction through bore 402.

Valve housing 406 is connected at its upper end through upper adapter 416 to the housing of a conventional tubing valve which prevents flow through the pipe string when closed. Preferably, an annulus pressure actuated tubing valve is used, arranged so that it closes at the same annulus pressure which opens injection valve 400 and opens when the pressure has dropped to the point at which injection valve 400 closes. Particularly preferred is the Halliburton APR ®-N Tester Valve.

Valve housing 408 is connected at its lower end through lower adaptor 418 to the lower string with the packer 44 and the pressure responsive firing head 54 and perforating gun 52.

The operation of this embodiment follows the same cycles as the operation of a preferred embodiment described above. The pipe string is run into the well with the tubing valve open and the injection valve shut. When the desired cushion depth is reached, the tubing is shut in by increasing the annulus pressure to close the tubing valve and open the injection valve. The pipe string then is run further in until the perforating gun is in position. The packer is set, and the annulus pressure released to open the tubing valve and close the injection valve. The annulus pressure is increased to test the packer, but is left below the predetermined pressure so that the valves do not change position. When the packer tests satisfactorily, the annulus pressure is increased to open the injection valve and close the tubing valve, and then increased to a sufficient pressure to actuate the firing head. Once the firing head is actuated, the annulus pressure is released, closing the injection valve and opening the tubing valve so that pressure in the tubing can be bled off.

Additional advantages and modifications will be readily apparent to those skilled in the art. The invention in its broader aspects is therefore not limited to the specific details, representative apparatus or the illustrative example shown and described. Accordingly, departures may be made from the detail without departing from the spirit or scope of the disclosed general inventive concept.

We claim:

1. An apparatus for completing a cased borehole, comprising:

a pipe string suspended within the cased borehole;

a packer disposed on the pipe string for forming a lower annulus and an upper annulus;

a flow valve located in the pipe string above the packer for preventing fluid flow through the flow bore of the pipe string when in the closed position;

an annulus access valve located in the wall of the pipe string below the flow valve and above the packer for permitting fluid flow from the upper annulus into the flow bore of the pipe string when in the open position;

a perforating gun suspended on the lower end of the pipe string;

a pressure responsive firing head disposed below the packer and connected to the perforating gun;

means for increasing the fluid pressure in the upper annulus;

a valve operating means for closing the flow valve while substantially simultaneously opening the annulus access valve to permit the increased fluid pressure in the upper annulus to be transmitted through the flow bore of the pipe string to the firing head so as to actuate the firing head and detonate the perforating gun.

2. The apparatus of claim 1, wherein the annulus access valve comprises a circulation port in the wall of the pipe string and a valve sleeve longitudinally slideably disposed in the pipe string, the valve sleeve having a circulation aperture alignable with the circulation port.

3. The apparatus of claim 2, wherein the valve operating means comprises a tubular mandrel means longitudinally slideably disposed against the interior wall of the pipe string, the tubular mandrel means being adapted to longitudinally move the valve sleeve between a first position in which the circulation aperture is aligned with the circulation port and a second position in which the circulation aperture is apart from the circulation port and being further adapted to close the flow valve when the valve sleeve is in the first position and open the flow valve when the valve sleeve is in the second position, and operating means adapted to effect the longitudinal movement of the mandrel means in response to pressure changes in the upper annulus.

4. The apparatus of claim 3, wherein the operating means comprises an operating fluid housed between the pipe string wall and the mandrel means in communication with the pressure in the upper annulus and a double-acting piston means disposed in the operating fluid and adapted to longitudinally move the mandrel means in response to pressure differentials across the double-acting piston means initiated in the operating fluid by the upper annulus pressure changes.

5. The apparatus of claim 4, which further comprises a ball and slot ratchet means associated with the operating means and the mandrel means and adapted to control the longitudinal movement of the mandrel means.

6. The apparatus of claim 5, wherein the double-acting piston means further includes operating fluid dump means adapted to limit the travel of the double-acting piston means.

7. The apparatus of claim 1, wherein the annulus access valve comprises a valve body located within a fluid access bore within the wall of the pipe stem, the fluid access bore communicating between the upper annulus and the interior of the pipe stem, the valve body having a head adapted to sealingly engage and close off the fluid access bore and being provided with means to retain the valve head in the sealing engagement until a predetermined pressure is applied to the upper annulus.

8. A method of completing a cased borehole, comprising:

suspending with the well a pipe string comprising a flow valve, an annulus access valve below the flow valve, a packer located below the annulus access valve, a pressure responsive firing head located below the packer and a perforating gun operated by the firing head located below the packer and adjacent to a hydrocarbon bearing formation;

setting the packer to form an upper annulus and a lower annulus;

closing the flow valve to prevent fluid flow through the flow bore of the pipe string;

opening the annulus access valve to permit fluid communication between the upper annulus and the firing head;

increasing the pressure in the upper annulus to a pressure sufficient to operate the firing head;

closing the annulus access valve and opening the flow valve;

detonating the perforating gun to perforate the casing into the formation; and flowing hydrocarbons from the formation through the perforations and up the flow bore of the pipe string to the surface.

9. The method of claim 8, wherein the steps of closing the flow valve, opening the annulus access valve, closing the annulus access valve and opening the flow valve are carried out by varying the pressure in the upper annulus.

10. A method of completing a well having a cased borehole, comprising:

suspending within the well a pipe string comprising a flow valve, an annulus access valve below the flow valve, a packer located below the annulus access valve, a pressure responsive firing head located below the packer and a perforating gun operated by the firing head located below the packer and adjacent to a hydrocarbon bearing formation;

setting the packer to form an upper annulus and a lower annulus;

closing the flow valve to prevent fluid flow through the flow bore of the pipe string;

opening the annulus access valve to permit fluid communication between the upper annulus and the firing head;

increasing the pressure in the upper annulus to a pressure sufficient to operate the firing head to facilitate detonation of the perforating gun;

closing the annulus access valve and opening the flow valve;

reducing the pressure in the flow bore of the pipe before the perforating gun detonates; and flowing hydrocarbons from the formation through the perforations and up the flow bore of the pipe string to the surface.

11. The method of claim 10, wherein the steps of closing the flow valve, opening the annulus access valve, closing the annulus access valve and opening the flow valve are carried out by varying the pressure in the upper annulus.

12. A well perforating device for use on a pipe string, comprising:

a flow valve for preventing fluid flow from the device to the pipe string when in the closed position;

an annulus access valve located below the flow valve in the wall of the device for permitting fluid flow from the well bore annulus into the flow bore of the device when in the open position;

a packer disposed on the exterior of the device below the annulus access valve for forming an upper annulus and a lower annulus;

a pressure responsive firing head for a perforating gun located within the flow bore of the device below the packer;

a valve operating means for closing the flow valve while substantially simultaneously opening the annulus access valve to permit the fluid pressure in the upper annulus to be transmitted through the flow bore of the device to the firing head.

13. The well perforating device of claim 12, wherein the annulus access valve comprises a circulation port in the wall of the pipe string and a valve sleeve longitudinally slideably disposed in the pipe string, the valve sleeve having a circulation aperture alignable with the circulation port.

14. The well perforating device of claim 13, wherein the valve operating means comprises a tubular mandrel means longitudinally slideably disposed against the interior wall of the pipe string, the tubular mandrel means being adapted to longitudinally move the valve sleeve between a first position in which the circulation aperture is aligned with the circulation port and a second position in which the circulation aperture is apart from the circulation port and being further adapted to close the flow valve when the valve sleeve is in the first position and open the flow valve when the valve sleeve is in the second position, and operating means adapted to effect the longitudinal movement of the mandrel means in response to pressure changes in the upper annulus.

15. The well perforating device of claim 14, wherein the operating means comprises an operating fluid housed between the pipe string wall and the mandrel means in communication with the pressure in the upper annulus and a double-acting piston means disposed in the operating fluid and adapted to longitudinally move the mandrel means in response to pressure differentials across the double-acting piston means initiated in the operating fluid by the upper annulus pressure changes.

16. The well perforating device of claim 15, which further comprises a ball and slot ratchet means associated with the operating means and the mandrel means and adapted to control the longitudinal movement of the mandrel means.

17. The well perforating device of claim 16, wherein the double-acting piston means further includes operating fluid dump means adapted to limit the travel of the double-acting piston means.

18. The well perforating device of claim 12, wherein the annulus access valve comprises a valve body located within a fluid access bore within the wall of the pipe stem, the fluid access bore communicating between the upper annulus and the interior of the pipe stem, the valve body having a head adapted to sealingly engage and close off the fluid access bore and being provided with means to retain the valve head in the sealing engagement until a predetermined pressure is applied to the upper annulus.

19. A downhole tool for controlling a perforating gun with a firing head, comprising:

a tubular tool housing;

a flow valve located in the tool housing for preventing fluid flow through the flow bore of the tool housing when in the closed position;

an annulus access valve located in the wall of the tool housing below the flow valve for permitting fluid flow from the well annulus into the flow bore of the tool housing when in the open position;

a valve operating means for closing the flow valve while substantially simultaneously opening the annulus access valve.

20. The apparatus of claim 19, wherein the annulus access valve comprises a circulation port in the wall of the tool housing and a valve sleeve longitudinally slideably disposed in the tool housing, the valve sleeve having a circulation aperture alignable with the circulation port.

21. The apparatus of claim 20, wherein the valve operating means comprises a tubular mandrel means longitudinally slideably disposed against the interior wall of the tool housing, the tubular mandrel means being adapted to longitudinally move the valve sleeve between a first position in which the circulation aperture is aligned with the circulation port and a second position in which the circulation aperture is apart from the circulation port and being further adapted to close the flow valve when the valve sleeve is in the first position and open the flow valve when the valve sleeve is in the second position, and operating means adapted to effect the longitudinal movement of the mandrel means in response to pressure changes in the well annulus.

22. The apparatus of claim 21, wherein the operating means comprises an operating fluid housed between the tool housing wall and the mandrel means in communication with the pressure in the well annulus and a double-acting piston means disposed in the operating fluid and adapted to longitudinally move the mandrel means in response to pressure differentials across the double-acting piston means initiated in the operating fluid by the well annulus pressure changes.

23. The apparatus of claim 22, which further comprises a ball and slot ratchet means associated with the operating means and the mandrel means and adapted to control the longitudinal movement of the mandrel means.

24. The apparatus of claim 23, wherein the double-acting piston means further includes operating fluid dump means adapted to limit the travel of the double-acting piston means.

25. The apparatus of claim 19, wherein the annulus access valve comprises a valve body located within a fluid access bore within the wall of the tool housing, the fluid access bore communicating between the well annulus and the interior of the tool housing, the valve body having a head adapted to sealingly engage and close off the fluid access bore and being provided with means to retain the valve head in the sealing engagement until a predetermined pressure is applied to the well annulus.

* * * * *